United States Patent [19]

Walton

[11] Patent Number: 4,477,717

[45] Date of Patent: Oct. 16, 1984

[54] FAST START GLOW PLUG

[75] Inventor: Frank T. Walton, Shelbyville, Ind.

[73] Assignee: Wellman Thermal Systems Corporation, Shelbyville, Ind.

[21] Appl. No.: 483,365

[22] Filed: Apr. 8, 1983

[51] Int. Cl.[3] ..... F23Q 7/22; F02P 19/00

[52] U.S. Cl. ..... 219/267; 29/613; 123/145 A; 219/270; 219/541; 361/266; 338/218

[58] Field of Search ..... 219/267, 270, 541; 29/611, 613, 615; 361/264, 265, 266; 123/145 A, 145 R; 338/217, 218

[56] References Cited

U.S. PATENT DOCUMENTS

| | | | |
|---|---|---|---|
| 2,898,571 | 8/1959 | Moule et al. | 123/145 A |
| 3,017,541 | 1/1962 | Lawser | 361/266 X |
| 3,158,787 | 11/1964 | Testerini | 123/145 A X |
| 3,562,590 | 2/1971 | Mitts | 219/270 X |
| 3,749,980 | 7/1973 | Baxter | 219/267 |
| 4,200,077 | 4/1980 | Kauhl et al. | 123/145 A |
| 4,211,204 | 7/1980 | Glauner et al. | 123/145 A |
| 4,252,091 | 2/1981 | Steinke | 123/145 A |
| 4,266,119 | 5/1981 | Best | 219/541 |
| 4,312,120 | 1/1982 | Comer | 29/611 |

FOREIGN PATENT DOCUMENTS

| | | | |
|---|---|---|---|
| 400854 | 8/1924 | Fed. Rep. of Germany | 123/145 A |
| 3003799 | 2/1980 | Fed. Rep. of Germany | 123/145 A |
| 245482 | 7/1926 | United Kingdom | 123/145 A |
| 2013277 | 8/1979 | United Kingdom | 219/270 |

*Primary Examiner*—Volodymyr Y. Mayewsky
*Attorney, Agent, or Firm*—Fitch, Even, Tabin & Flannery

[57] ABSTRACT

A glow plug has an outer metal housing have a wall defining an internal axially extending bore and a tubular heater that has an external tubular sheath of metal with a heated end of the sheath extending outwardly of the housing and an opposite internal end within the housing bore. The sheath is structurally secured to and electrically connected to the metal housing and the sheath has a closed outer end. An electrical heating element is positioned within the heater sheath and is electrically connected to the tubular sheath. The heating element has a conductor extending outwardly from the other end of the sheath. Electrical insulating material fills the space between the heating element and the sheath. An insulative compressible washer member is compressed between the sheath and the conductor to provide a first interference fit seal to prevent the flow of gas between the sheath and conductor and into the interior of the tubular heater. The wall defining the axially extending bore includes an upper tapered section that is of reduced diameter in the upward direction to compress the insulative compressible washer member as the tubular heater is forced further into the housing bore and includes an upper cylindrical section thereabove of a diameter smaller than the inlet side of the tapered section to engage and compress the compressible washer member to form a tight second interference fit seal between the housing and the tubular sheath to further upward flow of gas. An upper end of the sheath is compressed by the tapered section and then by the upper cylindrical section of the wall to make metal-to-metal contact therewith. The compressible washer member abuts and extends radially outwardly across the upper end of the sheath.

7 Claims, 6 Drawing Figures

FAST START GLOW PLUG

BACKGROUND OF THE INVENTION

This invention relates to a method of making glow plugs and to glow plugs which are used to ignite fuel in internal combustion engines with an internal electrical resistant element which is enclosed within a sheath and which is exposed to the fuel within the internal combustion chamber.

The present invention relates to a glow plug which is used in a diesel engine typically for powering an automotive engine for igniting the fuel quickly, for example, in under ten seconds, and which is produced at sufficiently low cost to be commercially competitive with existing glow plugs. It is to be appreciated that the glow plug is subjected to rather hostile, environmental conditions within the cylinder wherein engine vibrations are present, the temperature at the plug is at least 1100 degrees C., and the hot combustion gases are under high pressures and are corrosive in nature.

The heating element sheath projects outwardly into the combustion chamber from an encircling housing or casing which is usually threaded at one end and threaded into the cylinder block. The projecting portion of the tubular sheath is usually secured in a gas tight manner by brazing to the housing by a filler tight brazing at the end of the housing encircling the sheath. The brazing provides a gas tight seal between the sheath and the internal bore of the casing so that the high pressure gas for example at 400 psi at ignition time will not move along the interface between the sheath and the casing bore wall and eventually penetrate into the interior of the sheath at the open opposite end of the sheath. Such brazing is shown in U.S. Pat. No. 3,749,980.

The tubular heating element disposed within the housing has a central electrode projecting from its interior end which needs to be electrically isolated from the casing and which also needs to be sealed in a gas tight manner with respect to the sheath wall to prevent the intrusion of air bearing oxygen into the interior of the heating element. U.S. Pat. No. 4,252,091 discloses providing a grooved bushing having matching grooves to fit into the electrode and into the grooves formed in an end of the tubular sheath to provide a sealed, tortuous passage against the penetration of air into the interior of the heating element and into contact with the magnesium oxide and the heating element coil. Additionally, this patent discloses that a filler material having a high affinity to oxygen such as aluminum or magnesium may be placed over the top of the heating element and the bushing and captured below an "O" ring to assist in providing a gas tight seal against air intrusion into the interior of the tubular heater element. The present invention eliminates the necessity for the brazing operation such as disclosed in the U.S. Pat. No. 3,749,980 and provides a more simple and inexpensive interconnection between the glow plug housing and sheath. The present invention uses a compressible, insulative bushing which is compressed during assembly to provide an effective, air-tight seal not only between the surrounding housing and the tubular sheath but also between the externally projecting electrode and the tubular sheath to provide against penetration of oxygen into the interior of the heating element.

In accordance with the further aspect of the present invention there is provided a new and improved fast-start heating composite coil which uses a nickel element to allow the initial voltage to provide a fast start and a Kanthal coil portion to provide the heating. The increasing resistance of the nickel limits the maximum temperature. Such a fast heating of the plug followed by a self-regulating characteristic avoids the high operating temperatures which would be ultimately produced without the regulating feature of the nickel wire coil and yet, provides for more instantaneous starts of engines in cold climates wherein the delayed startup time has been a particular problem.

The present invention has solved the problem of how to provide a series resistive network for bringing the sheath up to ignition temperature and then to plateau so as not to exceed a predetermined temperatures for example about 2100 degrees F. after ninety seconds of operation. The present invention provides practical and effective fast start glow plug which will meet the necessary and commercially desired criteria for starting automotive engines in cold climates.

A general object of the invention is to provide a new and improved glow plug and method of making the same as contrasted with the prior art glow plugs as above described. Another object of the invention is to provide a new and improved mechanical seal in a glow plug to prevent the intrusion of oxygen into the interior of the heating element.

A still further object of the invention is to provide a new and improved fast start glow plug.

BRIEF DESCRIPTION OF THE DRAWING

These and other objects and advantages of the invention will become apparent from the following detailed description taken in connection with the accompanying drawings in which.

DETAILED DESCRIPTION OF THE INVENTION

Figure 1:
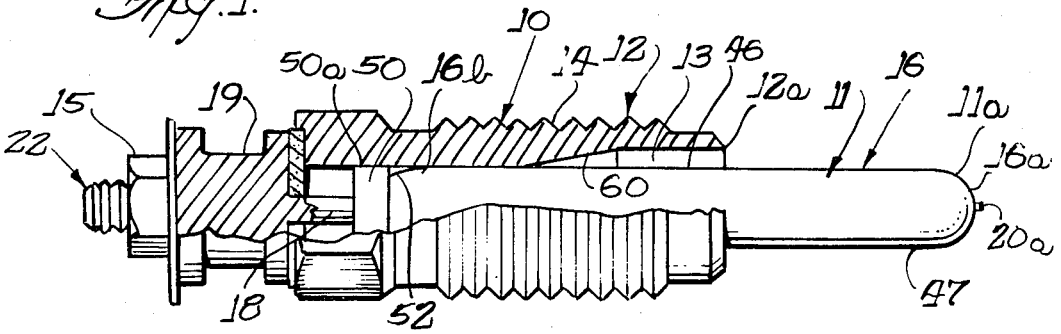
FIG. 1 is cross-sectional view of a glow plug constructed in accordance with the preferred embodiment of the invention.

As shown in the drawings for purposes of illustration, the invention is embodied in a glow plug 10 which is formed within an internal heating element 11 which has one end **11*a* projecting outwardly from a housing or casing 12 which has a threaded portion 14 for threading into an engine block. The housing 12 has a central axial bore 13 in which is mounted a hollow-cylindrical sleeve or sheath 16 of the heating element. Typically, the sheath is formed of stainless steel or other suitable material and has an outer closed end 16*a*. Within the sleeve is a central electrical conductor 18 which passes through a central bushing or washer 19 and a nut 15 to an outer connector terminal 22. The inner end of the conductor is connected to a heating coil or element 20 disposed within the sheath. The internal end 20*a* of the heating element coil is electrically connected to the end 16*a* of the sheath 16. The conductor is spaced from the sleeve 16 and likewise the heating element coil 20 is spaced from the sleeve 16 and each is supported and rigidly held by granular, insulative material 23, such as magnesium oxide, or the likepacked within the sheath 16 and about the conductor and the heating coil 20**.

Figure 4:
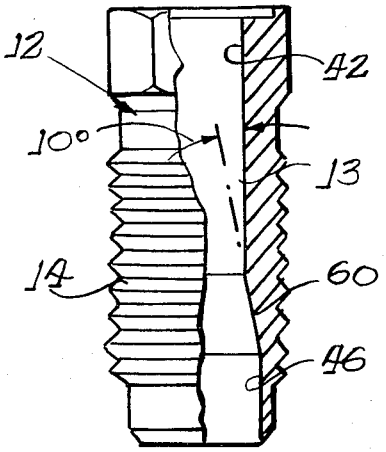
FIG. 4 is a view of the bushing.

The sheath closed end 16*a* is inserted into the combusion chamber for ignition of the fuel and needs to be brough rapidly up to temperature by means of a first coil portion 38 (FIG. 2) of a material which has a relatively constant resistance with temperature as compared to a second coil portion 40 which has a large variation in resistance with temperature change. Within the combustion chamber the pressure may reach as high as 480 psi which pressure causes gases to try to flow along the interface between an internal wall 42 in the casing defining the bore 13 for the casing 12 and the adjacent external surface 47 of the metallic sheath 16. The wall 42 is centered on the center line glow plug and extends axially along the center line of the glow plug as shown in FIG. 4. Heretofore, there was a braze or a weld formed at the end 12*a* of the bushing and the adjacent sheath to provide a gas tight seal. The present invention has an enlarged space, or gap in the form of a counterbore 46 at the end 12*a* of the casing to limit the amount of direct contact between the sheath surface 47 and the wall 42 of the casing bore 13. As will be seen, the gas pressure will flow up the counterbore and to the interface of the sheath wall surface 47 and the internal wall 42 of the bore 13 in the casing, or housing 12. If air under pressure reaches the outer end of the sheath, it must be sealed or air will tend to intrude through cracks and crevices into the interior of the sheath where it will attack the nickel and Kanthal coils 40 and 38.

In accordance with the present invention the conventional brazing seal between the outer metal casing 12 and the sheath 16 of the tubular heating element is eliminated and a gas tight seal therebetween is achieved mechanically. This is achieved by using a compressible gasket or washer 50 which is compressed with sufficient pressure during assembly of the tubular heating element 11 and the housing 12 to provide a seal not only between the housing and the sheath 16 but also between the conductor 18 and the sheath 16 so that no gas will penetrate into the interior of the heating element.

In the preferred embodiment of the invention, the silicone washer 50 is trapped within the sheath 16 by a crimped end 52 on the sheath prior to swaging of the sheath in the known manner. In this known and conventional swaging operation, the diameter of the sheath is reduced considerably and its length is increased. During the swaging operation, the end 50*a* of the silicone washer expands to project outwardly of end 16*b* of the sheath as shown in FIG. 3 and retains a larger diameter than that of the external wall 47 of the sheath. During such a swaging operation, there is provided a tight internal first seal 55 (FIG. 2) between the internal portion 50*b* of the washer 50 and the adjacent internal sidewall surface 56 (FIG. 2) of the sheath. Likewise, during the swaging operation the compressed washer will be obtaining a very tight and second seal 57 between the internal bore wall 50*c* of the washer and the conductor 18. Thus, when the assembly has been swaged to provide the configuration of FIG. 3 the first seal 55 and the second seal 57 will have been formed.

In accordance with an important aspect of the invention, the mechanical seal between the casing 12 and the sheath 16 is achieved by compressing the silicone washer 50 within a tapered wall section 60 of the bushing 12 adjacent the internal end of the counterbore 46. Herein the tapered wall has approximately a 10 degree taper and, is converging to a smaller diameter in the upward direction as viewed in FIG. 4 such that the projecting portion 50*a* of the silicone washer 50 is continually reduced in diameter as it is being compressed along the tapered wall section 60. The sheath end 16*b* is likewise being compressed by the tapered wall 60. It is this compression and compressing of the silicone washer under high force loading that provides an effective third seal which prevents the gases moving through the counterbore 46 and penetrating into the sheath and to the heating element as would allow oxygen to attack the heating coils 38 or 40.

Figure 2:
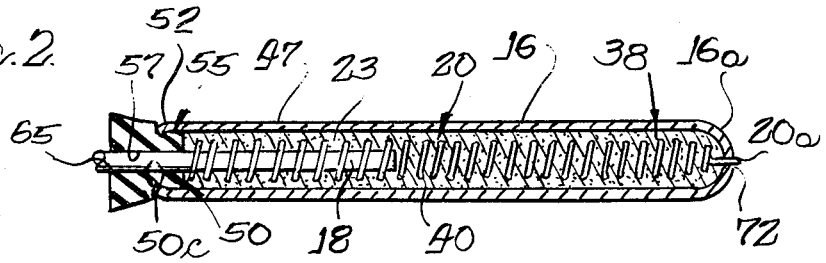
FIG. 2 is an enlarged partially sectional view of the heating element prior to extrusion.
Figure 3:
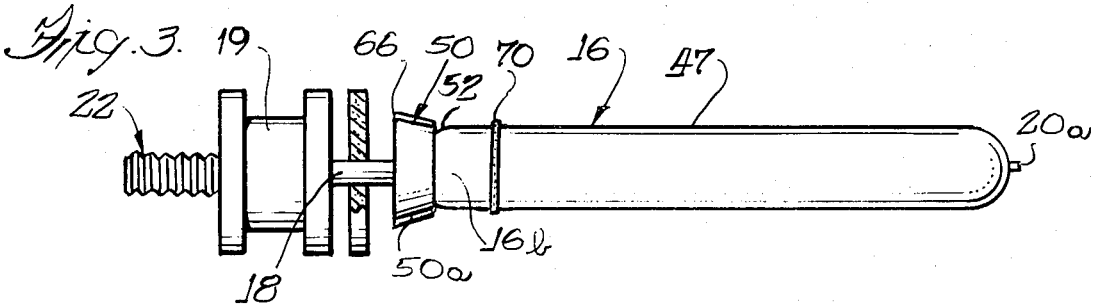
FIG. 3 is a view of the heating element after extrusion.

Referring now in greater detail to the preferred embodiment of the invention, the silicone washer 50 is annular in shape and is placed within the internal bore of the sheath 16 and is placed against the magnesium oxide which surrounds the conductor and the internal coil prior to extrusion, as seen in FIG. 2. The preferred material is a silicone rubber capable of withstanding high temperatures and having a low compression set.

The sheath end 16*b* is crimped at 52. A very small recess is provided as shown at 65 between the end of the washer 50 and the end of the crimped sheath 16*b*. During the conventional swaging operation, the washer 50 is squeezed to project outwardly through and to fill the the space 56 but also assumes a generally tapered or frusto-conical surface 66, as best seen in FIG. 3 with the portion 50*a* projecting outwardly beyond the end 16*b* of the sheath. This extruded external portion 50*a* of the silicone washer 50 has a substantially greater outer diameter than the outer diameter of the extruded sheath which has had its diameter reduced substantially from that shown in FIG. 2 to a smaller diameter after extrusion, and to have the overall appearance as shown in FIG. 3. In addition to the compressed washer seal, the preferred embodiment of the invention also uses a cement, or adhesive which is applied as a ring 70 onto the exterior wall 47 of the sheath 16 below the washer 50 for cementing engagement with the bore wall 42 of the housing 12. The preferred ring of cement is sold under the Trademark "Lock Tite" No. RC 620 by the Lock Tite Corporation.

In assembly, the sheath 16 with the washer 50 and the cement ring 70 thereon, as shown in FIG. 3, are pressed fitted into the housing to a predetermined dimension as measured from the external end 12*a* of the housing 12 to assure that there is the compression desired and that the cement is engagement with the internal bore wall 42 of the housing at the desired location.

Figure 5:
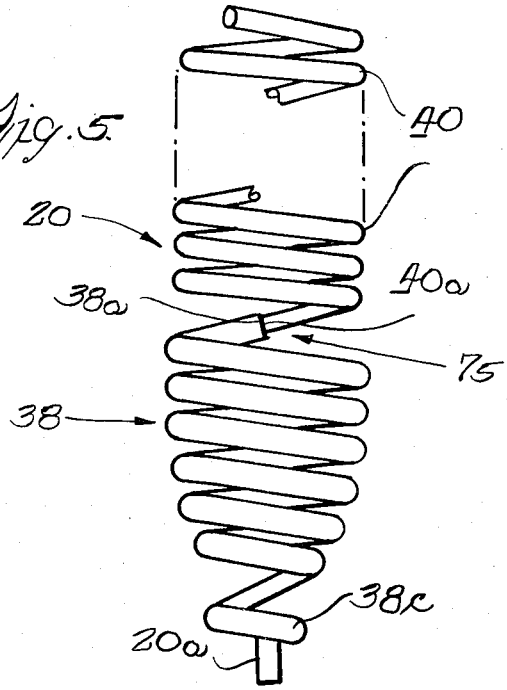
FIG. 5 is an enlarged view of the heating element having the composite coils and constructed in accordance with the preferred embodiment of the invention.
Figure 6:
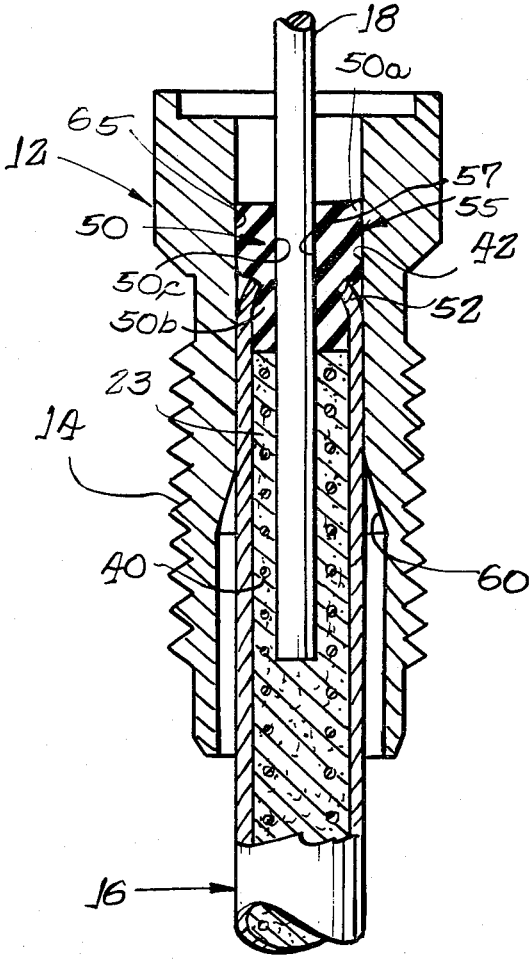

In accordance with another important aspect of the present invention the coils 38 and 40 are constructed in accordance with the preferred embodiment of the invention as shown in FIG. 5 with their respective ends 40*a* and 38*a* abutted end-to-end with a weld 75 therebetween to mechanically join the ends together and to electrically connect the ends together. This preferred weld is made by lazer welding or other percussion weld or a butt weld. This is in contrast to the type of side-by-side relationship of the coil end as shown in British patent publication No. 2,013,277A. With the present invention both of the coils 38 and 40 may be wound with the same hand whereas, in the British publication the coils are wound with opposite hands and the ends are laid parallel to each other for welding. The parallel ends of the British publication are more difficult to prevent from contacting the sheath and shorting out the coil. The preferred heating as shown in FIG. 5 has the Kanthal A-1 coil 38 with a larger diameter than the nickel coil 40 and it has a substantially reduced number of coils, for example, about seven coils with the coils reducing vary substantially in diameter from a maximum o.d. to the smallest diameter coil 38*c* (FIG. 5). In order to heat the hemispherical sheath end 16A as quickly as possible, the coil 38 is formed with the coils assuming a generally hemispherical shape to be close to the sheath end wall 16A. On the other hand, the nickel coil 40 has a substantial constant diameter throughout. In this preferred embodiment of the invention a small axially located aperture 72 is formed in the closed end 16*a* of the sheath and the straight end 20*a* of the coil is projected therethrough followed by an inert arc welding to seal the sheath to gas leakage and to ground the coil to the sheath end 16*a*. The electrical circuit for the glow plug is from the outer connecter terminal 22 through the conductor 18 to the upper end of the coil 40, through the coil 40 and through the coil 38 to the coil end 20*a* attached to the sheath end 16*a* and through the sheath 16 upwardly to the compressed metal-to-metal contact with the internal wall 42 of the housing 12 and through the housing 12 to the engine (not shown).

It has been found by tests that when 11 volts are applied that the composite coil will heat the sheath to a temperature of 1562 degrees F. at a location of three millimeters up the sheath length from the tip 16*a* within six to ten seconds. After about 90 seconds the temperature will have plateaued off and will be in the range of 2040–2140 degrees F. Also, these plugs will withstand 12.5 volts for 120 seconds.

Because of the high temperature co-efficient of resistance of the nickel resistor coil 40 compared to the heating coil 38 from cold start to operating temperature, the resistance of the nickel coil 40 increased by 500 to 600 percent while the increase of resistance of the heating coil is less than 10 percent. This stabilized resistance of a coil 38 minimizes excessive starting current surge.

From the foregoing it will be seen that the present invention provides an improved mechanical seal for use in glow plug of various constructions. The improved seal is of particular utility in the fast start glow plug herein described.

While a preferred embodiment of the invention has been shown and described it will be understood that there is no intent to limit the invention by such disclosure but rather it is intended to cover all modifications and alternative constructions falling within the spirit and scope of the invention as defined in the appended claims.

I claim:

1. A glow plug comprising:

an outer metal housing having a wall defining an internal axially extending bore, a tubular heater having an external tubular sheath of metal with a heated end of the sheath extending outwardly of the housing and an opposite internal end within the housing bore, said sheath being structurally secured and electrically connected to the metal housing, said sheath having a closed outer end, an electrical heating element positioned within the heater sheath and electrically connected to the tubular sheath and having a conductor extending outwardly from the other end of the sheath, electrical insulating material filling the space between the heating element and the sheath, and an insulative compressible washer member compressed between the sheath and the conductor to provide a first interference fit seal to prevent the flow of gas between the sheath and conductor and into the interior of the tubular heater, the wall defining the axially extending bore including an upper tapered section being of reduced diameter in the upward direction to compress the insulative compressible washer member as the tubular heater is forced further into the housing bore and including an upper cylindrical section thereabove of a diameter smaller than the inlet side of the tapered section engaging and compressing the compressible washer member to form a tight second interference fit seal between the housing and the tubular sheath to further upward flow of gas, an upper end on said sheath compressed by said tapered section and then by said upper cylindrical section of said wall and having metal-to-metal contact therewith, said compressible washer member abutting and extending radially outwardly across the upper end of said sheath.

2. A glow plug in accordance with claim 1 including a ring of cement between said housing bore wall and said metal sheath to aid in preventing gas intrusion into the tubular heater.

3. A glow plug in accordance with claim 1 in which the insulative compressible member is a silicone washer, said washer having an internal portion within the metal sheath and abutting the electrically insulating material and outer portion projecting outwardly of the metal sheath and compressed by engagement with the wall of the housing to provide a seal therewith.

4. A fast start glow plug comprising:

an outer metal housing having a wall defining an internal bore, a tubular heater disposed with the housing bore and having a tubular metal sheath extending outwardly from one end of the housing, a heating element in the tubular sheath having one end electricity connected to a closed end of the sheath and having a conductor extending outwardly of the other end of the sheath and the outer housing, an insulating material in the sheath and disposed about the heating element, the heating element including first and second coils coiled in the same helical direction joined together, each of the coils having ends abutted end-to-end and welded together to form an electrical connection therebetween, the wall defining the internal bore of the outer housing an upper cylindrical section in metal-to-metal compressive engagement with the inner end of the sheath to provide electrical contact therewith and sealing engagement therebetween, an inlet section to said internal bore having a diameter substantially larger than the sheath and spacing the housing from the sheath as said inlet section by a substantial air gap, the coil in the sheath having a substantially greater increase in resistance being located at the inlet section of the housing, a tapered section in said wall defining the internal bore of the housing decreasing in diameter in the inward direction from inlet end to the upper cylindrical section to compress the upper end of the sheath wall and providing electrical contact therebetween, and an insulative compressible member compressed between the sheath and conductor and between the conductor and the upper cylindrical section of the wall to prevent the flow of gas into the interior of the heating element.

5. A glow plug in accordance with claim 4 in which said sheath has a closed hemi-spherical end and in which the adjacent coil end is also hemi-spherical in shape.

6. A glow plug in accordance with claim 4 in which the first coil is wound with a shape with larger diameter turns of the first coil connected to the second coil and with the turns decreasing in diameter toward the closed end.

7. A glow plug in accordance with claim 6 in which the first coil is formed with a straight lead end, the closed tubular end of the sheath having a bore therein into which is projected the straight lead end of the first coil to electrically connect the first coil to the closed sheath end.

* * * * *